United States Patent [19]

Simko

[11] Patent Number: 4,682,575

[45] Date of Patent: Jul. 28, 1987

[54] LOW FRICTION HIGH SPEED ROCKER ARM

[75] Inventor: Aladar O. Simko, Dearborn Heights, Mich.

[73] Assignee: Ford Motor Company, Dearborn, Mich.

[21] Appl. No.: 846,386

[22] Filed: Mar. 31, 1986

[51] Int. Cl.[4] ..... F01L 1/18

[52] U.S. Cl. ..... 123/90.44; 123/90.43; 123/90.27; 123/90.39; 123/90.5

[58] Field of Search ..... 123/90.43, 90.44, 90.27, 123/90.39, 90.46, 90.5

[56] References Cited

U.S. PATENT DOCUMENTS

| | | | |
|---|---|---|---|
| 1,710,291 | 4/1929 | Brush | 123/90.43 |
| 2,014,659 | 9/1935 | Moorhouse | 123/90 |
| 2,089,203 | 8/1937 | Griswold | 123/90 |
| 2,871,839 | 2/1959 | Mekkes | 123/90 |
| 3,045,657 | 7/1962 | Sampietro | 123/90.43 |
| 3,463,131 | 8/1969 | Dolby | 123/90.43 |
| 4,491,099 | 1/1985 | Bonvallet | 123/90.44 |
| 4,543,920 | 10/1985 | Bonvallet | 123/90.44 |

FOREIGN PATENT DOCUMENTS

| | | | |
|---|---|---|---|
| 144990 | 6/1920 | United Kingdom | 123/90.43 |

*Primary Examiner*—Ira S. Lazarus

*Attorney, Agent, or Firm*—Robert E. McCollum; Clifford L. Sadler

[57] ABSTRACT

A rocker arm construction suitable for high-speed operation with low-friction consisting of a one-piece essentially U-shaped rocker arm having a bottom portion continuous in material from end to end with an upraised cylindrical surface portion constituting a fulcrum engaged with a stationary lash adjuster mounted in a housing secured to the rocker arm cover, the housing also including a rib portion straddling a roller cam follower rotatably mounted on one end of the rocker arm, the rib portion having a recess, the surface of which defines an epicyclic curve generated by a point on the roller cam follower as it rolls about a cam lobe on the chamshaft, the latter curve providing a pure rolling motion of the cam follower on the cam lobe and assuring a pure rolling motion of the rocker arm on the fulcrum line contact with the lash adjuster, the opposite end of the rocker arm engaging the end of a valve stem for reciprocation thereof.

7 Claims, 2 Drawing Figures

LOW FRICTION HIGH SPEED ROCKER ARM

Figure 1:
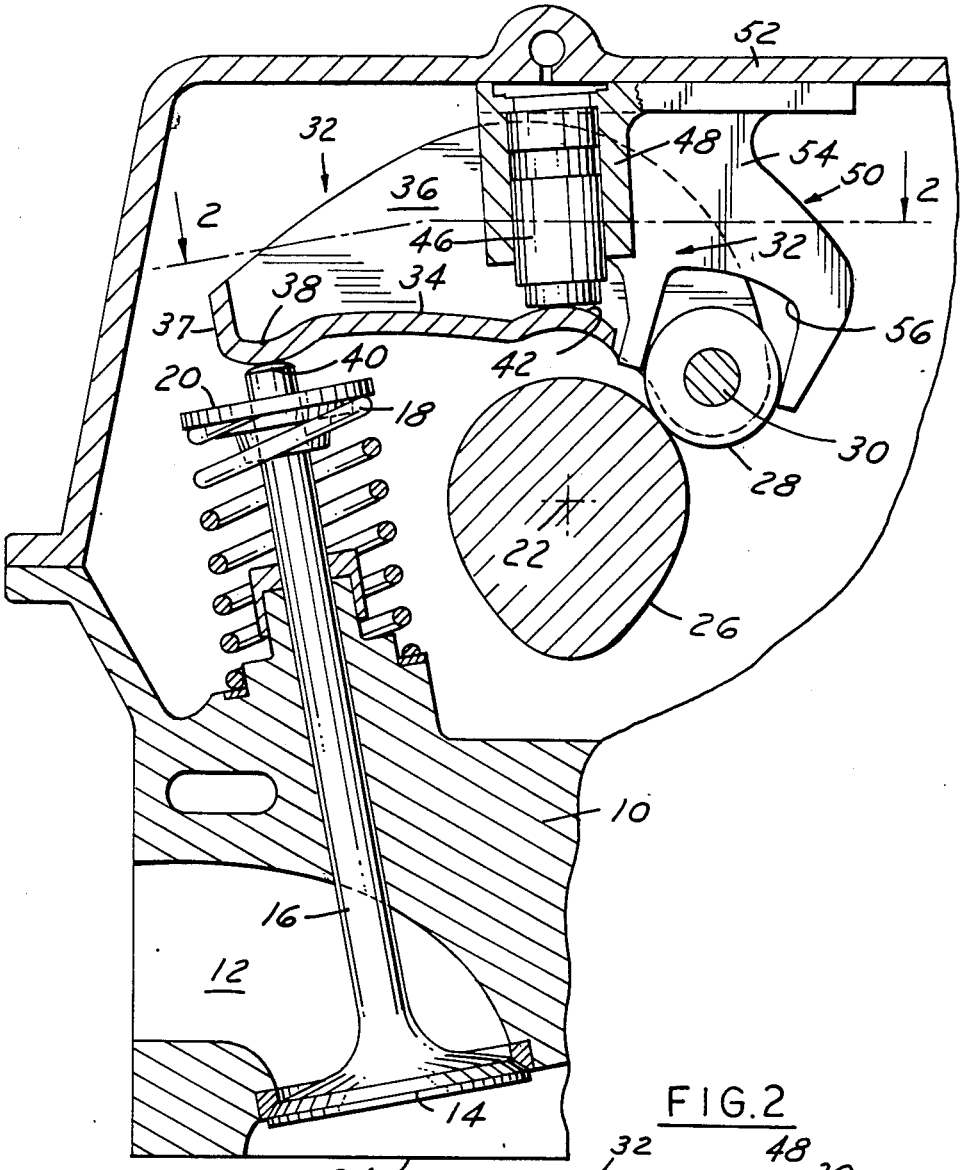

This invention relates in general to an overhead camshaft type valve train for an internal combustion engine, and more particularly to one that operates efficiently at high speed with low friction.

Valve trains for overhead camshaft engines can take varying forms or constructions, for a number of reasons. For example, a direct acting bucket actuator could be used in which the overhead cam lobe, bucket with hydraulic lash adjuster, and the valve are all aligned providing a direct line of force to the valve. This has the advantage of excellent high speed capability due to the close coupling of the cam lobe and valve stem. The disadvantages, however, are that the camshaft is located high above the engine, which increases engine height. Also, this type of construction does not lend itself to a roller cam follower, which provides less friction, due to dimensional limitations on the cam and roller diameter that would locate the camshaft even higher. Furthermore, the hydraulic lash control in this case would be subjected to the full valve travel because it would travel with the bucket. This would not only increase the height but also the reciprocating weight of the valve train. The spring rate also would be very high, while the amount of deflection, however, would be at a minimum.

A second form of overhead camshaft valve actuator is the so-called finger follower in which a roller type fulcrum engaged by the cam lobe is mounted on a bearing intermediate opposite ends of a lever with the opposite ends engaging a stationary hydraulic lash control unit and a valve stem. The advantages are fairly high stiffness for high speed capability, and a stationary hydraulic lash control unit, which reduces the reciprocating weight of the valve train. Again, however, it causes the camshaft location to be high over the engine, and comparable to that of the bucket type actuator. A further disadvantage is the necessity of a bearing insert for the roller follower.

A third kind of valve train would be the conventional rocker arm stud mounted to the cylinder head with opposite ends engaging the valve and a tappet. This would be the most compact construction and would be suitable for use with a roller follower engaging the cam lobe. However, a hydraulic lash adjustment necessarily would be incorporated either in the tip of one end of the rocker arm or in the movable cam follower tappet. This, again, would increase the reciprocating weight of the valve train, which would render it not suitable for high speed use. A further disadvantage would be the high frictional forces and bending moment at the fulcrum point because of the length. It would also increase the flexibility, which would be a disadvantage for high speed operation.

This invention provides a valve train construction having the advantages of the prior discussed constructions with few of the disadvantages. More particularly, the invention provides a valve train layout that includes a low mounted camshaft to reduce the engine height. Also, it has the stiffness of a finger follower type rocker arm for high speed operation, and a stationary lash adjuster. It has means to provide a pure rolling motion of the rocker arm without the use of a roller fulcrum, and thereby provides low friction and a firm support. It is without material discontinuity in the area of the highest bending moment; i.e., at the fulcrum, and has rocker arm lateral guidance due to the sides of the rocker arm being guided by the housing for the stationary lash adjuster.

It is a primary object of the invention, therefore, to provide a valve train layout for an overhead camshaft type engine that has high speed capability with low friction, a fewness of parts, a simplicity of construction, and one that is efficient in operation.

Figure 2:
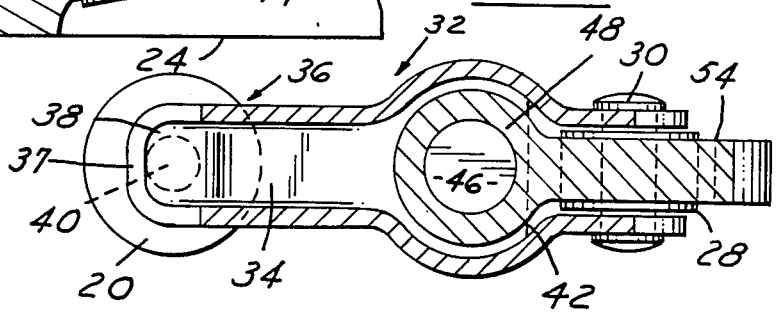

Other objects, features and advantages of the invention will become more apparent upon reference to the succeeding detailed description thereof and to the drawings illustrating the preferred embodiment thereof, wherein:

FIG. 1 schematically illustrates a cross-sectional view of a portion of an internal combustion engine cylinder head embodying the invention; and FIG. 2 is a cross-sectional view taken on a plane indicated by and viewed in the direction of the arrows II—II of FIG. 1.

Valve trains having individual features similar to those discussed above are known. For example, U.S. Pat. No. 2,871,839, Mekkes, shows a conventional stud mounted rocker arm type valve train with a stationary hydraulic lash adjuster. However, it shows nothing else, it being of the push-rod actuated type, rather than for an overhead camshaft engine.

U.S. Pat. No. 2,014,659, Moorhouse, shows an engine with a low mounted camshaft, a roller follower and a stationary lash adjuster; however, the arrangement of the parts of the valve train results in a very high engine construction as well as a complicated one.

U.S. Pat. No. 2,089,203, Griswold, shows in FIGS. 1 and 2 a roller follower engaging the cam lobe, which is engine block mounted.

FIG. 1 shows a portion 10 of the cylinder head of an automotive type internal combustion engine. It includes in this case an exhaust manifold gas passage 12 controlled by a reciprocating valve 14 attached to a valve stem 16. The usual valve return spring 18 and keeper mechanism 20 are provided. A camshaft, the axis of which is indicated at 22, is mounted low over the engine as close as possible to the top of the cylinder head and in close proximity to the face 24 of the cylinder head. The camshaft includes a cam lobe 26 that is engaged at all times by a roller follower 28 rotatably mounted at 30 to the end of a one-piece rocker arm 32. As indicated in FIG. 2, the rocker arm is of a continuous U-shaped construction with an essentially flat bottom wall 34. Extending from the bottom are two upstanding spaced sidewalls 36 joined at one end 37. The lower outer surface portion 38 of the one end is shaped to provide a line contact with the upper end 40 of valve stem 16 to minimize frictional forces between the two.

The bottom wall 34 in this case is continuous from one end of the rocker arm to the other end; i.e., the bottom surface is without discontinuities from one end to the other, which provides rigidity or stiffness to the rocker arm. At near a central location, bottom wall 34 is provided with an upraised spherically shaped portion 42. The latter constitutes a cylindrical surface for a line contact with the bottom end of an adjustable hydraulic lash adjuster 46. The latter could be one of many known types, the details of construction and operation of which, therefore, are not given since they are believed to be unnecessary for an understanding of the invention. The lash adjuster in this case is mounted in a tubular-like portion 48 of a support housing 50 fixed to and depending from a rocker arm cover 52.

As best seen in FIG. 2, housing 50 includes a rib-like stiffener 54 integral with housing portion 48. The lower portion of rib 54 projects downwardly into the hollow of the rocker arm between the sidewalls 36 forming a yoke-like construction.

The lower portion of rib 54 is recessed at 56 to closely straddle the roller follower 28, as indicated in FIG. 1. The opening defining recess 56 is shaped in the form of an epicycloidal curve to establish a pure rolling motion without friction of the roller follower 28 upon the cam lobe 26. The attainment of this pure rolling motion, by means of an epicycloidal curve, is described more fully in British Pat. No. 41962 to Solomon, on page 3, wherein is described that a point on a circle rolling without sliding on another circle generates an epicycloidal curve.

The operation of the valve train described above is believed to be clear from the previous description and a consideration of the drawings and, therefore, will not be repeated in detail. Suffice it to say that the use of the cylindrical fulcrum 42 provides for a pure rolling motion of the rocker arm about the lash adjuster without the use of a roller bearing insert. This provides a motion with a firm support and low friction. The use of an epicycloidal track for the cam follower roller 28 provides guidance for the roller and assures the pure rolling motion at the fulcrum 42 with only a miniscule induced friction. The rotating roller 28 also provides for good lubrication of the contact line between the roller 28 and tract 56.

The described construction further provides a low-cost rocker arm because of the material continuity at the area of the highest bending moment; i.e., there is no hole in the center for a fulcrum and, therefore, the rocker arm has greater stiffness with minimum deflection and bending moments. The rocker arm further is guided laterally in a direction parallel to the camshaft by the vertical sidewalls of the rocker arm straddling the cylindrical housing 48 and rib 54.

From the foregoing, therefore, it will be seen that the invention provides a low-cost, high-speed, lowfriction type rocker arm construction providing light reciprocating weight, moderate cost, compact dimensions, low engine height, the advantages of a roller cam follower without a roller bearing insert, the stiffness of a finger follower type rocker arm for high speed capability, and a stationary lash adjuster.

While the invention has been shown and described in its preferred embodiment, it will be clear to those skilled in the arts to which it pertains that many changes and modifications may be made thereto without departing from the scope of the invention. For example, the hydraulic lash adjuster could be replaced by a mechanical adjustment in the form of an adjustment screw. Also, in certain cases, it might be desirable to build the lash adjuster housing of all of the rocker arms serving one cylinder out of one piece of casting or sintered metal. This would appear to be especially desirable for a four-valve arrangement where the one-piece housing would save space and reduce the number of bolts required to attach the unit to the cylinder head or to the rocker cover. It also would be possible to combine the lash adjuster housing with the camshaft upper bearing caps to form a single casting for one cylinder head.

What is claimed:

1. A valve train for an internal combustion engine comprising, a camshaft mounted close above the cylinder head face of the engine, a one-piece essentially U-shaped rocker arm mounted above the camshaft for an arcuate movement and defined by a bottom wall integral with a pair of laterally spaced upstanding side walls, the bottom wall having a cylindrical fulcrum surface projecting upwardly therefrom, a lash adjuster fixedly supported above the rocker arm against lateral movement and having a lower surface engaging the cylindrical fulcrum surface with a contact establishing a pure rolling motion without friction of the rocker arm upon the lash adjuster lower surface, a reciprocatingly mounted valve stem engaging one end of the rocker arm for reciprocation of the valve, the other end of the rocker arm rotatably supporting a dual function roller engagable with a cam lobe on the camshaft for arcuate pivoting of the rocker arm about its fulcrum upon rotation of the camshaft, support means supporting the roller for both an arcuate movement of its axis of rotation along a predetermined path providing a pure rolling motion of the rocker arm about its fulcrum upon the lash adjuster surface and confining the roller and arm in a manner preventing longitudinal sliding movement of the rocker arm fulcrum surface relative to the lash adjuster surface.

2. A valve train as in claim 1, wherein the support means includes a cam track forcing movement of the roller axis along the predetermined path.

3. A valve train as in claim 2, wherein the track is shaped so that a point on the periphery of the roller generates an epicycloidal curve as the roller rotates on the cam lobe providing a pure rolling motion of the roller upon the cam lobe.

4. A valve train as in claim 2, wherein the track is formed as an epicycloidal curve.

5. A valve train as in claim 1, wherein the rocker arm bottom is continuous from one end to the other providing stiffness thereto.

6. A valve train as in claim 1, wherein the means fixedly supporting the lash adjuster includes means movably supporting the roller and confining the rocker arm against lateral and longitudinal movement.

7. A valve train as in claim 6, wherein the latter means includes rib-like support means projecting into the hollow interior of the rocker arm between the side walls thereof and having a yoke-like recess within which the roller is received for forcing a predetermined movement of the roller and laterally and longitudinally confining the rocker arm.

* * * * *